US007598913B2

(12) United States Patent
Rao et al.

(10) Patent No.: US 7,598,913 B2
(45) Date of Patent: Oct. 6, 2009

(54) SLOT-LOADED MICROSTRIP ANTENNA AND RELATED METHODS

(75) Inventors: Qinjiang Rao, Waterloo (CA); Geyi Wen, Waterloo (CA); Dong Wang, Waterloo (CA); Mark Pecen, Waterloo (CA)

(73) Assignee: Research In Motion Limited, Waterloo, Ontario (CA)

( * ) Notice: Subject to any disclaimer, the term of this patent is extended or adjusted under 35 U.S.C. 154(b) by 0 days.

(21) Appl. No.: 11/737,878

(22) Filed: Apr. 20, 2007

(65) Prior Publication Data

US 2008/0258989 A1 Oct. 23, 2008

(51) Int. Cl.
*H01Q 1/38* (2006.01)

(52) U.S. Cl. ..... 343/700 MS; 343/846

(58) Field of Classification Search ..... 343/700 MS, 343/767, 770, 829, 846, 848, 702
See application file for complete search history.

(56) References Cited

U.S. PATENT DOCUMENTS

| | | | | |
|---|---|---|---|---|
| 4,063,246 | A * | 12/1977 | Greiser | 343/700 MS |
| 4,170,013 | A * | 10/1979 | Black | 343/700 MS |
| 4,613,868 | A | 9/1986 | Weiss | 343/700 MS |
| 4,771,291 | A * | 9/1988 | Lo et al. | 343/700 MS |
| 6,255,995 | B1 * | 7/2001 | Asano et al. | 343/700 MS |
| 6,400,322 | B2 | 6/2002 | Fang et al. | 343/700 MS |
| 6,429,819 | B1 * | 8/2002 | Bishop et al. | 343/725 |
| 6,914,563 | B2 | 7/2005 | Chen et al. | 343/700 MS |
| 7,126,544 | B2 | 10/2006 | Liu et al. | 343/700 MS |
| 7,145,510 | B2 | 12/2006 | Liu et al. | 343/700 MS |
| 2006/0132373 | A1 | 6/2006 | Yuanzhu | 343/767 |
| 2007/0126638 | A1 * | 6/2007 | Channabasappa | 343/700 MS |

OTHER PUBLICATIONS

Chen, *Suspended Plate Antennas with Shorting Strips and Slots*, IEEE Transactions on Antennas and Propagation, vol. 52, No. 10, Oct. 2004.

Bandwidth-Enhancing of Microstrip Antenna with a Couple of $TM_{10}$ Modes, Xiao et al., Antennas and Propagation Society Symposium, 2005. IEEE Washington, DC, Jul. 3-8, 2005, Piscataway, NJ, IEEE US, Jul. 3, 2005, pp. 495-498 vol. 1A, XP010857915, ISBN: 0-7803-8883-6.

(Continued)

*Primary Examiner*—Tho G Phan
(74) *Attorney, Agent, or Firm*—Yee & Associates, P.C.

(57) ABSTRACT

A microstrip antenna may include an electrically conductive ground plane layer, a dielectric layer adjacent the electrically conductive ground plane layer, and an electrically conductive patch layer adjacent the dielectric layer on a side thereof opposite the electrically conducive ground plane layer. The electrically conductive patch layer may be electrically floating with respect to the electrically conductive ground plane layer and may comprise a body portion and a feed strip extending outwardly from an interior medial portion of the body portion. The feed strip may have opposing first and second sides and an end electrically connected to the body portion. The body portion may have spaced apart first and second slots adjacent respective ones of the first and second opposite sides of the feed strip, and a third slot adjacent the end of the feed strip and spaced from the first and second slots.

26 Claims, 13 Drawing Sheets

OTHER PUBLICATIONS

Modified Slot-Loaded Triple-Band Microstrip Patch Antenna, Cho et al. IEEE Antennas and Propagation Society International Symposium, 2002 Digest APS, San Antonio, TX, Jun. 16-21, 2002 New York, IEEE, US, vol. 1 of 4, Jun. 16, 2002, pp. 500-503, XP010593186, ISBN: 0-7803-7330-8.

"Inset Microstripline-Fed Circularly Polarized Microstrip Antennas", Chen et al., IEEE Transactions on Antennas and Propagation, IEEE Service Center, Piscataway, NJ, US, vol. 48, No. 8, Aug. 2000, XP011003842, ISSN: 0018-926X.

"A study on Rectangular Microstrip Antenna with Group of Slots for Compact Operation", Vani et al., Microwave and Optical Technology Letters, vol. 40, No. 5, Apr. 5, 2004, pp. 396-398, XP002448190.

"Bandwidth Enhancement of Inset-Microstrip-Line-Fed Equilateral-Triangular Microstrip Antenna", Electronics Letters, IEEE Stevenage, GB, vol. 34, No. 23, Nov. 12, 1998, pp. 2184-2186, XP006010612.

* cited by examiner

SLOT-LOADED MICROSTRIP ANTENNA AND RELATED METHODS

FIELD OF THE INVENTION

The present invention relates to the field of communications devices, and, more particularly, to mobile wireless communications devices and related methods.

BACKGROUND OF THE INVENTION

Cellular communications systems continue to grow in popularity and have become an integral part of both personal and business communications. Cellular telephones allow users to place and receive voice calls most anywhere they travel. Moreover, as cellular telephone technology has increased, so too has the functionality of cellular devices and the different types of devices available to users. For example, many cellular devices now incorporate personal digital assistant (PDA) features such as calendars, address books, task lists, etc. Moreover, such multi-function devices may also allow users to wirelessly send and receive electronic mail (email) messages and access the Internet via a cellular network and/or a wireless local area network (WLAN), for example.

Even so, as the functionality of cellular communications devices continues to increase, so too does the demand for smaller devices which are easier and more convenient for users to carry. One challenge this poses for cellular device manufacturers is designing antennas that provide desired operating characteristics within the relatively limited amount of space available for the antenna.

Microstrip antennas are one type of antenna that have unique features such as low profile, low weight, low cost and relatively easy fabrication, which has led to their use in mobile wireless communications devices. A typical prior art microstrip patch antenna 100 is shown in FIG. 1 which has a length L and width W. The length L is usually chosen to be a half-wavelength of the operating frequency of the antenna 30. However, to obtain lower operating frequencies, the value of L typically has to be increased (i.e., the antenna 30 is made larger), which is undesirable within a mobile wireless communications device where space is at a premium.

Another prior art microstrip patch antenna 200 is shown in FIG. 2, which implements one common approach to obtain a lower resonant frequency while at the same time maintaining a relatively small antenna size. In particular, the antenna 200 has shorted ground pins 201 positioned transversely across a vertical centerline of the antenna, as shown. This approach allows the physical length of the antenna 200 to be reduced to one-quarter of the operating wavelength $\lambda$. Yet, due to the reduced effective aperture, the antenna gain is also undesirably decreased.

Still another prior art approach for reducing the size of a microstrip antenna is to use a folded, multi-layer (i.e., non-planar) structure than can effectively reduce the antenna size to $\frac{1}{8}\lambda$ or even more on its aperture plane. One drawback of this approach is that it necessarily results in increased thickness, which may be particularly undesirable in small handsets. Another drawback of this approach, as well as using shorting ground pins, is that these structures may be somewhat difficult, and potentially more expensive, to manufacture.

Other prior art microstrip antenna designs are set forth in U.S. Pat. Nos. 7,126,544 and 7,145,510 both to Liu et al.; U.S. Pat. No. 6,400,322 to Fan et al.; U.S. Pat. No. 4,613,868 to Weiss; and U.S. patent publication no. 2006/0132373 to Yuanzhu, for example.

Accordingly, new microstrip antenna designs may be desirable that allow the above-noted advantages to be achieved without significant increases in size/thickness or manufacturing difficulty.

DETAILED DESCRIPTION OF THE PREFERRED EMBODIMENTS

Figure 1:
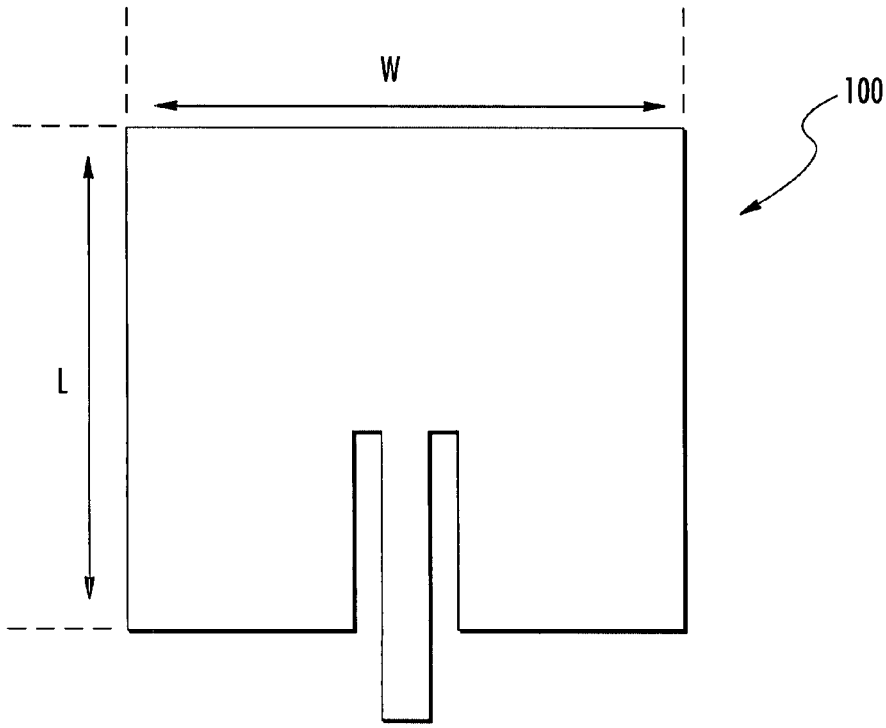
FIG. 1 (PRIOR ART)
FIG. 1 is a top view of a prior art microstrip antenna.
Figure 2:
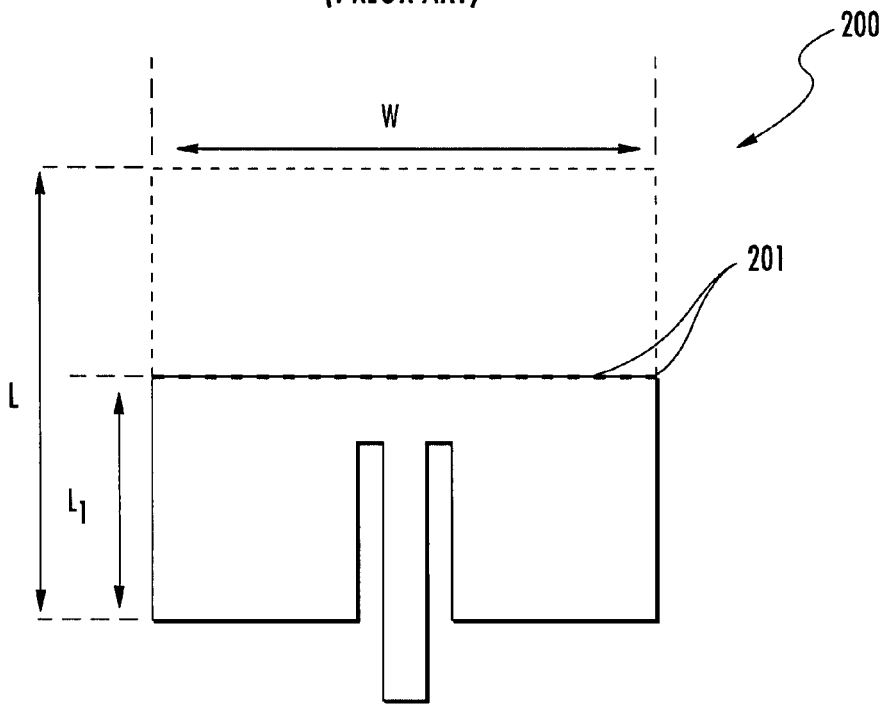
FIG. 2 (PRIOR ART)
FIG. 2 is a top view of another prior art microstrip antenna.

The present description is made with reference to the accompanying drawings, in which preferred embodiments are shown. However, many different embodiments may be used, and thus the description should not be construed as limited to the embodiments set forth herein. Rather, these embodiments are provided so that this disclosure will be thorough and complete. Like numbers refer to like elements throughout, and prime notation is used to indicate similar elements in different embodiments.

Generally speaking, a microstrip antenna is disclosed herein which may include an electrically conductive ground plane layer, a dielectric layer adjacent the electrically conductive ground plane layer, and an electrically conductive patch layer adjacent the dielectric layer on a side thereof opposite the electrically conducive ground plane layer. The electrically conductive patch layer may be electrically floating with respect to the electrically conductive ground plane layer and may comprise a body portion and a feed strip extending outwardly from an interior medial portion of the body portion. More particularly, the feed strip may have opposing first and second sides and an end electrically connected to the body portion. Also, the body portion may have spaced apart first and second slots adjacent respective ones of the first and second opposite sides of the feed strip, and a third slot adjacent the end of the feed strip and spaced from the first and second slots.

The electrically conductive patch layer may be a planar electrically conductive layer, for example. Moreover, the planar electrically conductive patch layer may have a rectangular shape. Additionally, the first and second slots may each be elongate and extend parallel to the feed strip. The first and second slots may also have identical shapes and be symmetrically positioned with respect to the feed strip.

In addition, the third slot may have an elongate shape and extend in a direction transverse to a direction of the feed strip. More particularly, the third slot may have opposing ends symmetrically positioned with respect to the feed strip. Alternatively, the third slot may have opposing ends asymmetrically positioned with respect to the feed strip. Further, the feed strip may comprise an elongate electrically conductive strip with the opposing sides in spaced relation from adjacent portions of the body portion. The feed strip may extend along a vertical centerline of the body portion, for example.

A mobile wireless communications device is also disclosed which generally includes a housing and a microstrip antenna carried by the housing, such as the one described briefly above. Moreover, a wireless communications circuit may be carried by the housing and coupled to the microstrip antenna.

A method aspect for making a microstrip antenna is also disclosed which may include positioning a dielectric layer adjacent an electrically conductive ground plane layer, and positioning an electrically conductive patch layer, such as the one described briefly above, adjacent the dielectric layer on a side thereof opposite the electrically conducive ground plane layer.

Figure 3:
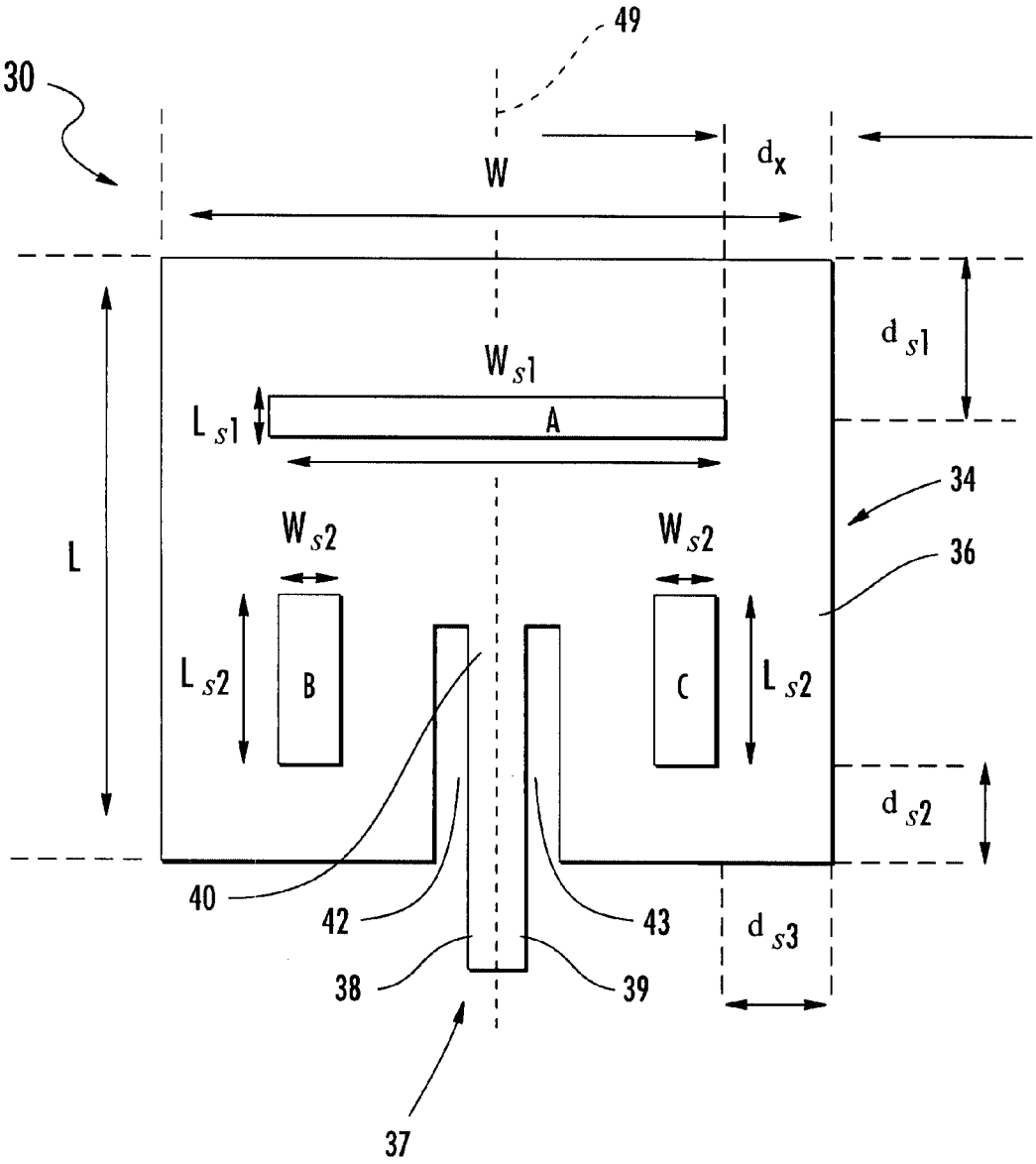
FIG. 3. is a top view of a microstrip antenna in accordance with one exemplary embodiment.
Figure 4:
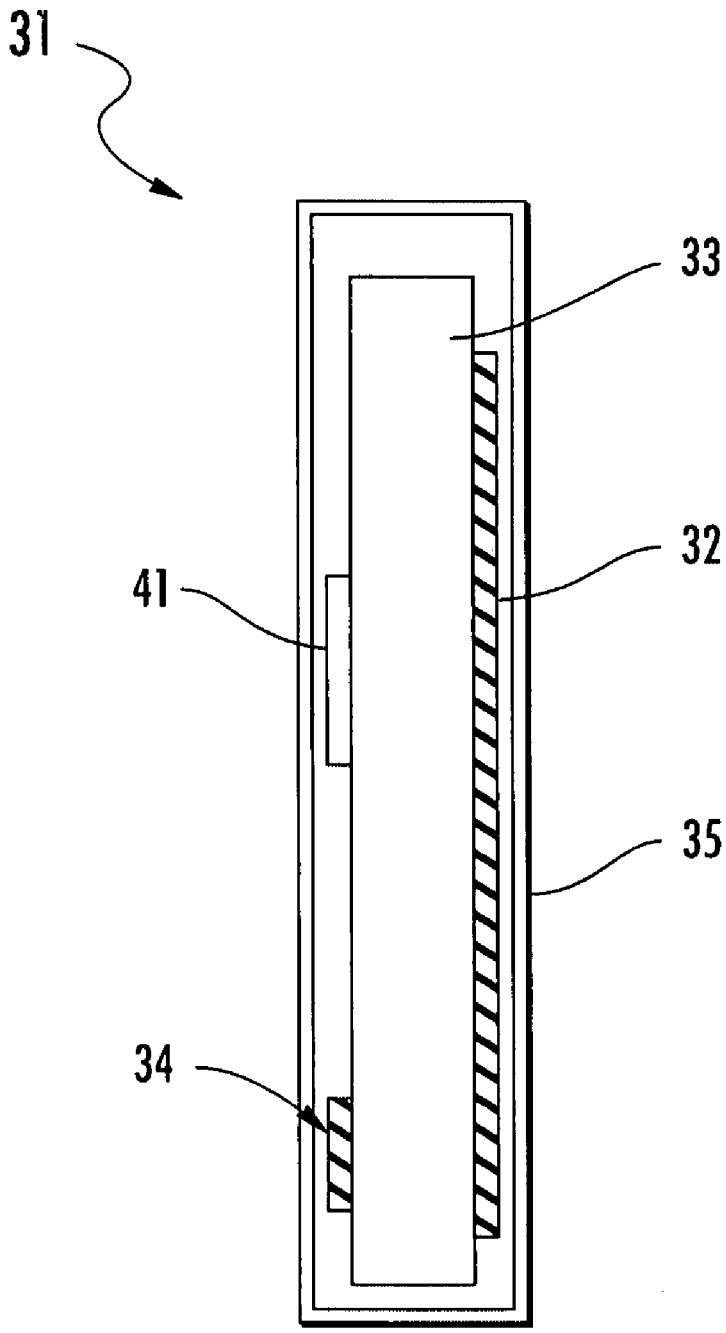
FIG. 4 is a schematic side view of a wireless communications device including a microstrip antenna, such as the one illustrated in FIG. 3.

Referring now to FIGS. 3 and 4, a microstrip antenna 30 that may advantageously be used in a mobile wireless communications device 31 (e.g., a cellular device) in accordance with one exemplary aspect is first described. The antenna 30 illustratively includes an electrically conductive ground plane layer 32, a dielectric substrate or layer 33 adjacent the electrically conductive ground plane layer 32, and an electrically conductive patch layer 34 adjacent the dielectric layer 33 on a side thereof opposite the electrically conducive ground plane layer 32, as shown.

The antenna 30 is preferably carried within a housing 35 of the device 31. The patch layer 34 may be positioned at various locations within the device 31, such as adjacent the top (i.e., near the output speaker), or adjacent the bottom (i.e., near the input microphone), or therebetween. Moreover, the antenna 30 may be used for different types of wireless communication beside cellular, such as WLAN communications (e.g., 802.11x, Bluetooth), etc., as will be appreciated by those skilled in the art. To this end, one or more wireless communications circuits 41 (e.g., transmitter/receiver) may be carried by the dielectric layer 33, as will be discussed further below.

The patch layer 34 is preferably electrically floating with respect to the ground plane layer 32, although a connection or "short" to the ground plane may be used in some embodiments if desired. The patch layer 34 illustratively includes a body portion 36 and a feed strip 37 extending outwardly from an interior medial portion of the body portion along a centerline 49 thereof, as shown. More particularly, the feed strip 37 is an elongate electrically conductive strip having opposing first and second sides 38, 39 and an end 40 electrically connected to the body portion at the interior medial portion. The opposing sides of the feed strip 37 are in spaced relation from adjacent portions of the body portion (i.e., vertical slots 42, 43 separate the first and second sides 38, 39 from the body portion 36). The feed strip 37 is also symmetrically positioned with respect to the centerline 49 in the exemplary embodiment, although this need not be the case in all embodiments, and other placements of the feed strip are also possible.

In the example embodiment illustrated in FIGS. 3 and 4, the patch layer 34 is advantageously a planar electrically conductive layer having a rectangular shape defined by length L and width W. More particularly, in the present example the length L and width W are equal to define a square patch, but other dimensions may be chosen in different embodiments to provide other rectangular shapes.

The body portion 36 also advantageously includes spaced apart first and second slots B, C adjacent respective ones of the first and second opposite sides 38, 39 of the feed strip 37, and a third slot A adjacent the end 40 of the feed strip and spaced from the first and second slots B, C to advantageously define a slot-loaded patch element. The slots may be etched in the body portion 36, for example, during manufacturing, as will be appreciated by those skilled in the art.

In the example embodiment shown in FIGS. 3 and 4, the first and second slots B, C are each elongate with a same vertical length $L_{s2}$ and extend parallel to the feed strip 37. The first and second slots B, C also have a same width $W_{s2}$. While in the example embodiment the first and second slots B, C are rectangular, it should be noted that in other embodiments the first and second slots B, C need not have a same shape (i.e., one or both of the slots may have a shape other than rectangular), nor the same dimensions.

In addition to having identical shapes in the present example, the first and second slots B, C are also symmetrically positioned with respect to the feed strip 37. The third slot A also has an elongate rectangular shape and extends in a direction transverse to a direction of the feed strip 37. The third slot A has a horizontal width $W_{s1}$ and a vertical length $L_{s1}$, as shown. As with the first and second slots B, C, the third slot A may have a shape other than rectangular, as well as different dimensions and placements on the body 36.

In the presently described embodiment, the third slot A is positioned a vertical distance $d_{s1}$ from the top of the body portion 36, and a horizontal distance $d_x$ from the right side of the body portion. In this exemplary embodiment, the horizontal distance $d_x$ is chosen so that the opposing ends of the third slot A are symmetrically positioned with respect to the feed strip 37. In other embodiments, such as the antenna 30' shown in FIG. 12, the third slot A may have opposing ends that are asymmetrically positioned with respect to the feed strip 37.

The first and second slots B, C of the example embodiment depicted in FIGS. 3 and 4 are positioned a vertical distance $d_{s2}$ from the bottom of the body portion 36, and a horizontal distance $d_{s3}$ from the sides of the body portion. While these distances are the same in the embodiment of FIG. 3, the slots B, C need not be symmetrically positioned in all embodiments with respect to the feed strip 37.

By way of comparison, a prior art microstrip patch antenna 100 as shown in FIG. 1 having a resonant frequency of around 2 GHz was compared with a microstrip antenna 30 in accordance with one embodiment having substantially the same dimensions (i.e., the same length L and width W). From the simulated and measured results described below it will be appreciated that with loaded slots the resonant frequency of the antenna 30 is decreased to 1.5 GHz without introducing any shorted ground pins or folded multi-layered structures, as typically required with prior art microstrip antenna configurations.

Figure 5:
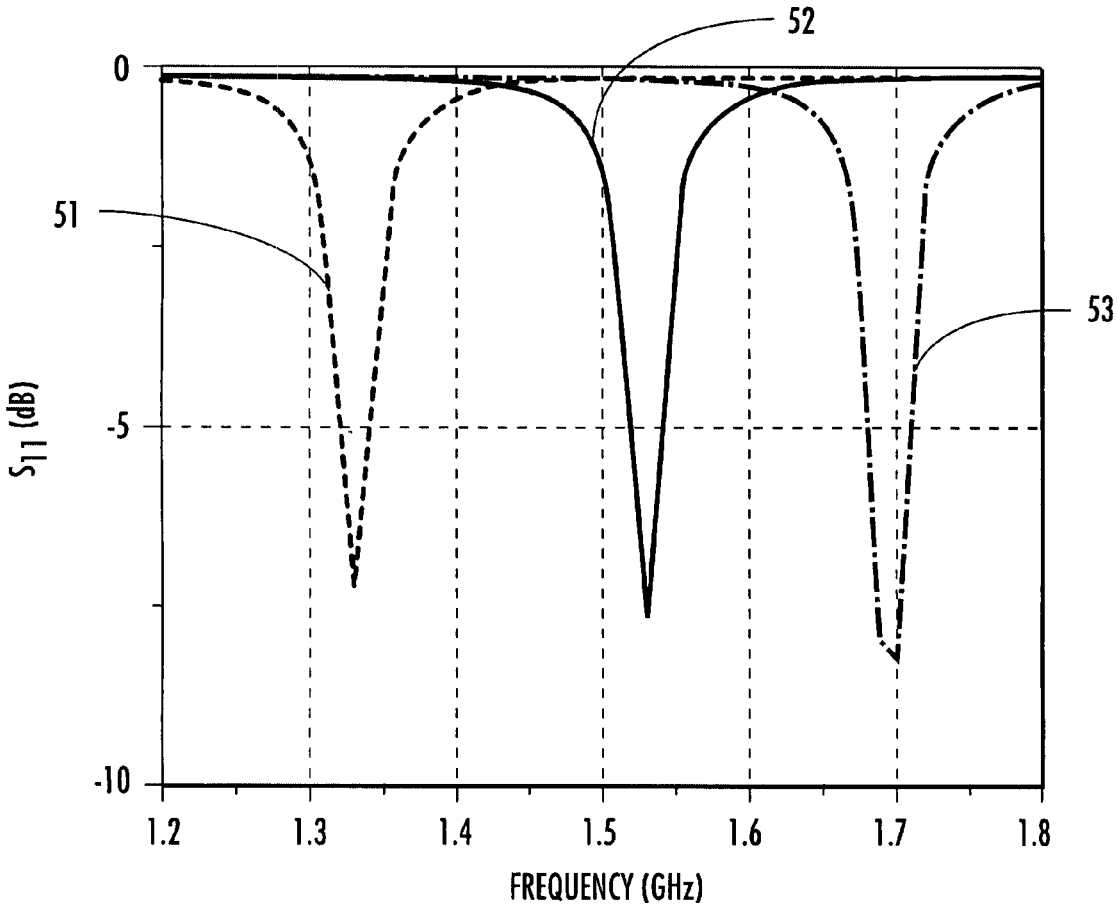
FIGS. 5-7 are graphs of simulated return loss vs. frequency for different configurations of the antenna of FIG. 3.
Figure 6:
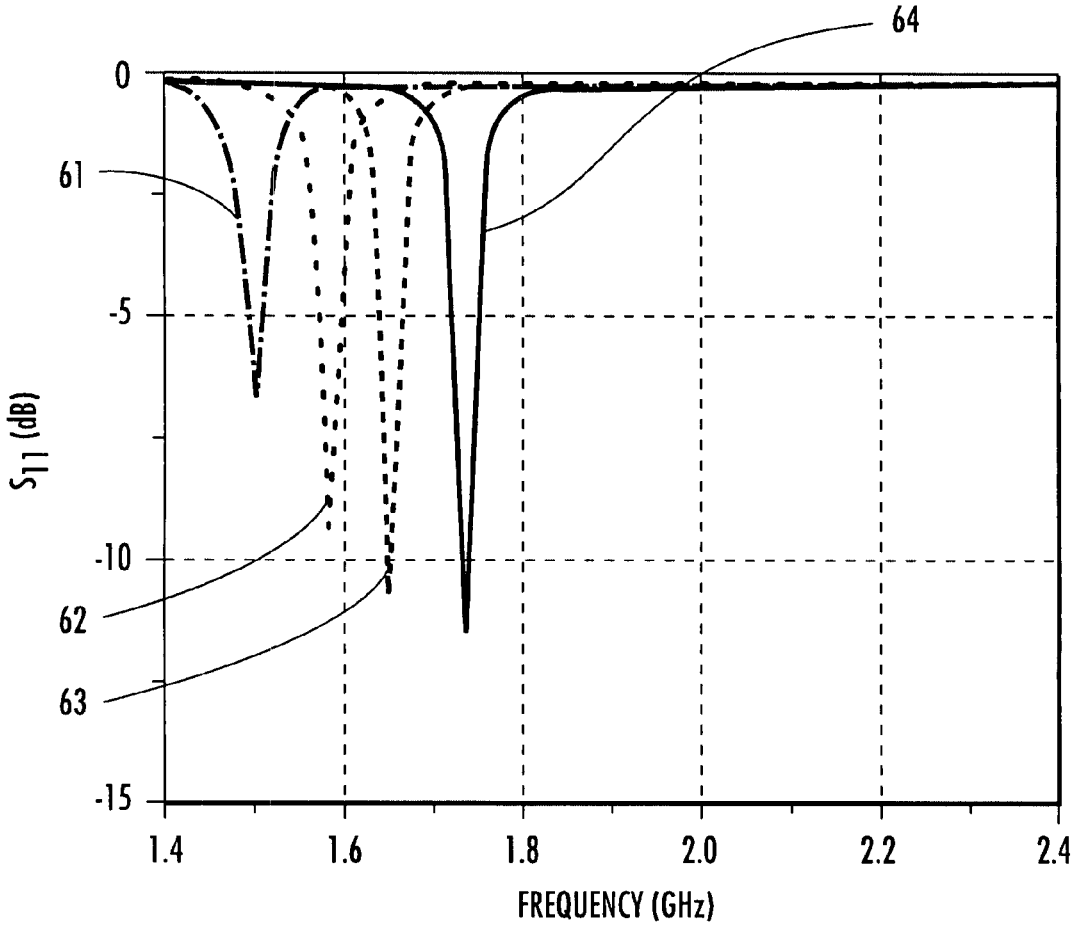
Figure 7:
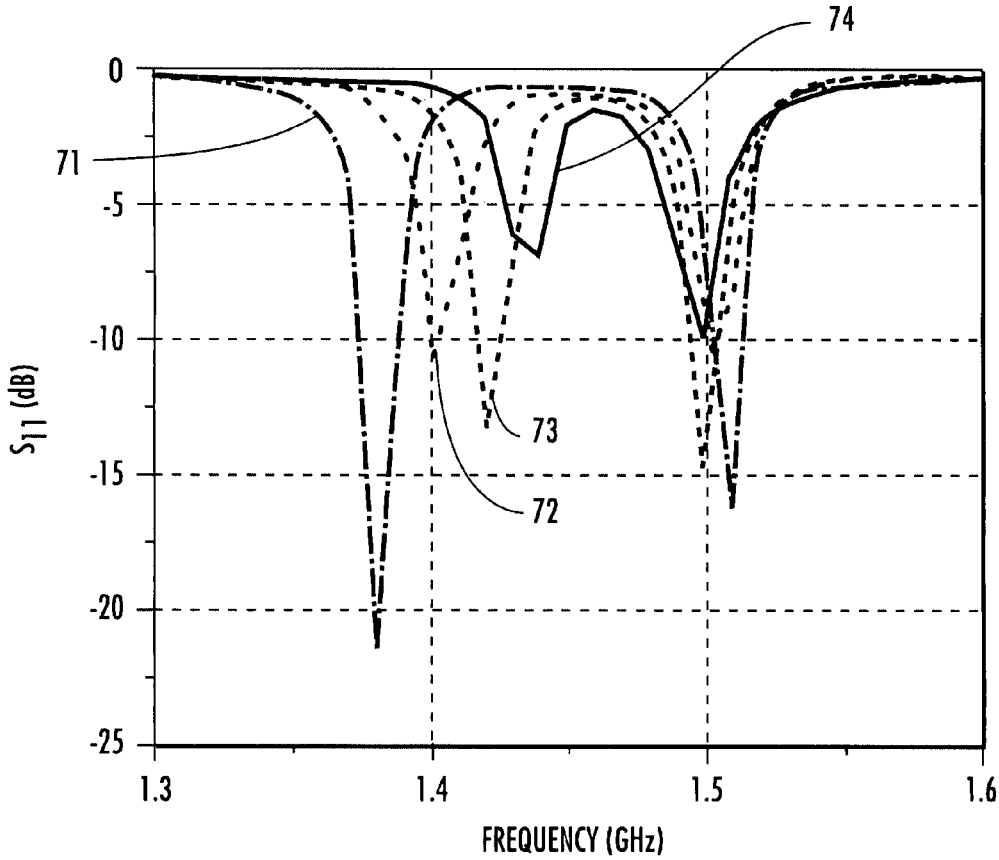

Generally speaking, the length $W_{s1}$ and the distances $d_{s1}$ and $d_x$ of slot A control the main current distributions, and hence define the effective electrical length and resonant frequency of the antenna 30. The dimensions of slots B and C are identical in the present embodiment, and they are symmetrically placed on the opposing sides 38, 39 of the feed line 37 for finely adjusting the resonant frequency and improving impedance matching. The graph of FIG. 5 illustrates the influence of the width $W_{51}$ on resonant frequency. Plots 51-53 respectively correspond to lengths L of 29 mm, 23 mm, and 17 mm all with a same distance $d_{s1}$ of 5 mm. Moreover, plots 61-64 (FIG. 6) demonstrate the influence of $d_{s1}$ on resonant frequency for a width $W_{s1}$ of 23 mm for $d_{s1}$ values of 5 mm, 9 mm, 11 m, and 13 nm, respectively. Referring additionally to FIG. 7, the effect of $d_x$ on resonant frequency for a width $W_{s1}$ of 23 mm and distance $d_{s1}$ of 5 mm are shown by plots 71-74 corresponding respectively to $d_x$ values of 2 mm, 3 mm, 4 mm, and 5 mm.

Figure 8:
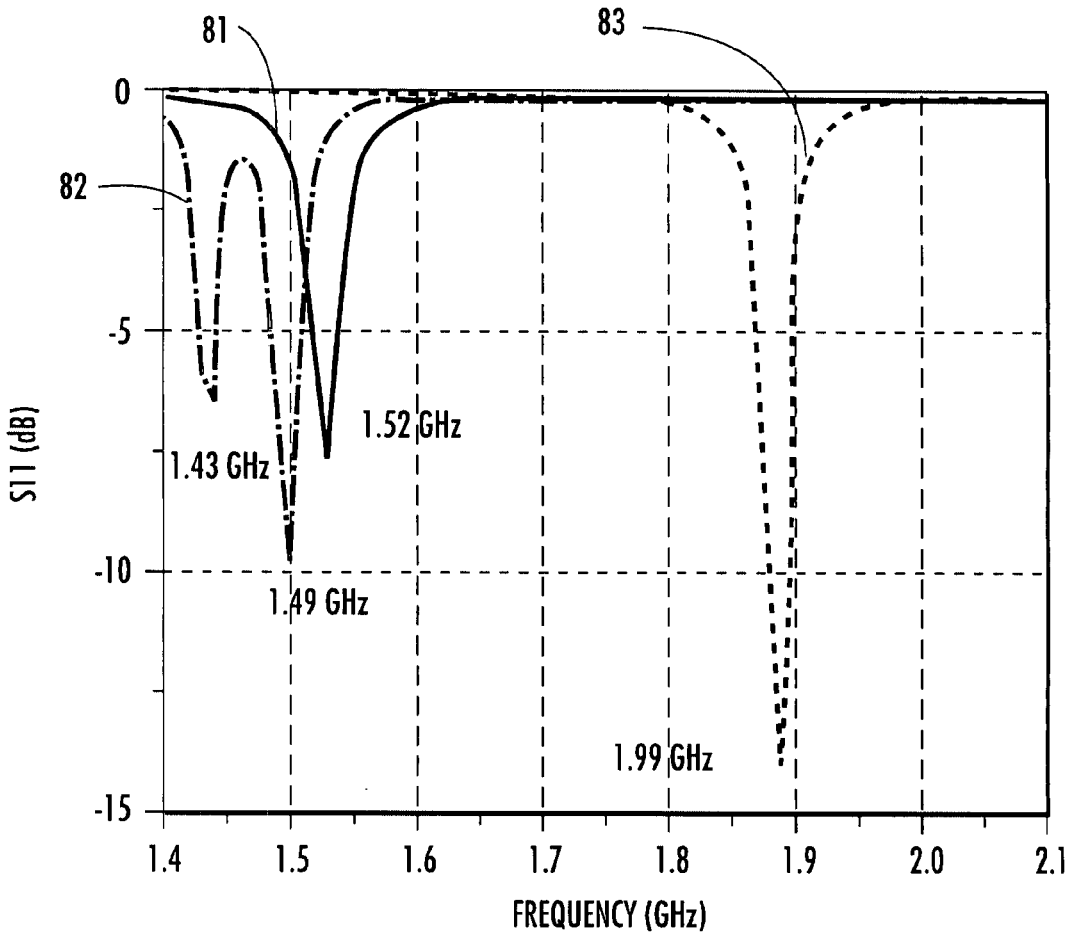
FIGS. 8-9 are, respectively, graphs of simulated and measured return loss vs. frequency for a prior art microstrip antenna and two slot loaded microstrip antenna embodiments.
Figure 9:
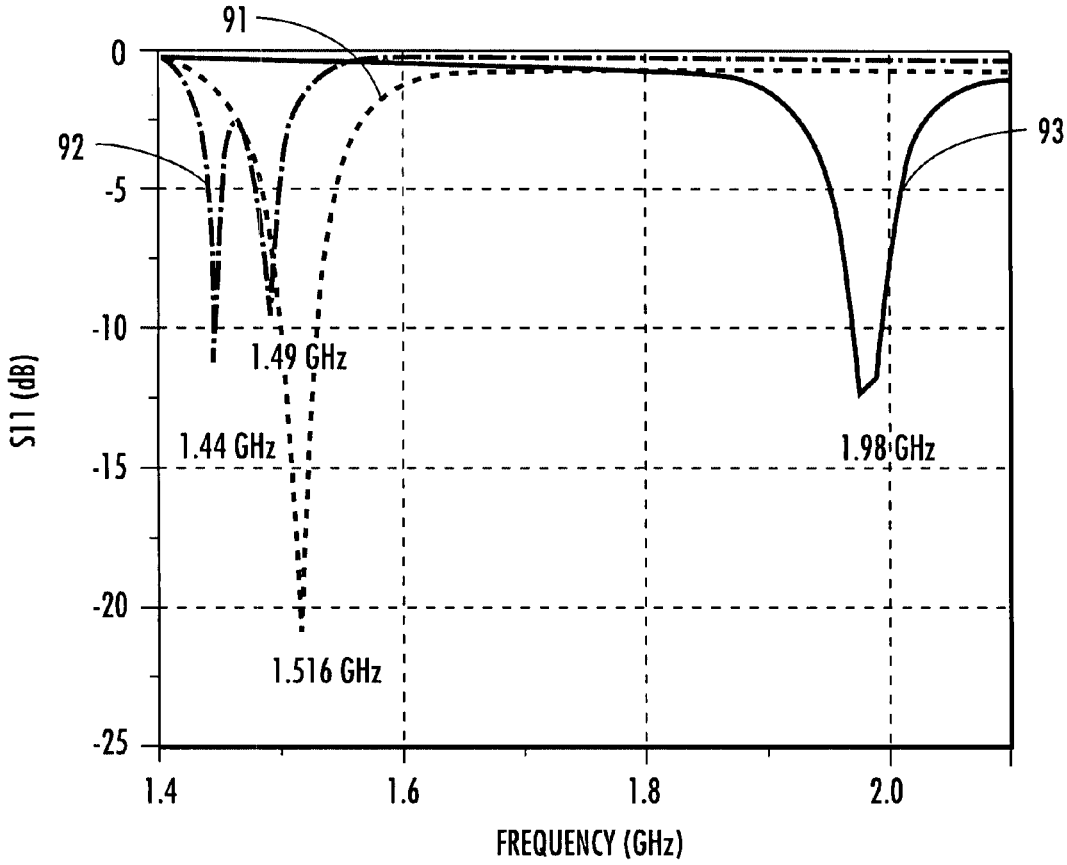
Figure 12:
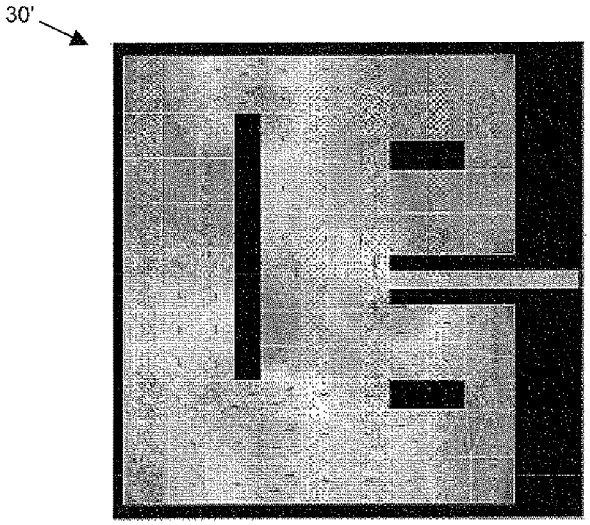
FIG. 12 is a top view of an alternative embodiment of the microstrip antenna of FIG. 3 showing simulated current distribution therefor at a frequency of 1.49 GHz.

Turning now additionally to FIGS. 8 and 9, simulated and measured return losses are respectively shown for the prior art microstrip antenna 100, the microstrip antenna 30 including a symmetrical slot A with respect to the feed strip 37, and an alternative microstrip antenna 30' with an asymmetrical slot A (FIG. 12). As will be appreciated by those skilled in the art, the simulated and measured results demonstrate good correlation therebetween. In FIGS. 8 and 9, the plots 81, 91 correspond to the microstrip antenna 30 including a symmetrical slot A, the plots 82, 92 correspond to the microstrip antenna 30' with an asymmetrical slot A, and the plots 83, 93 correspond to the prior art microstrip antenna 100.

Figure 10:
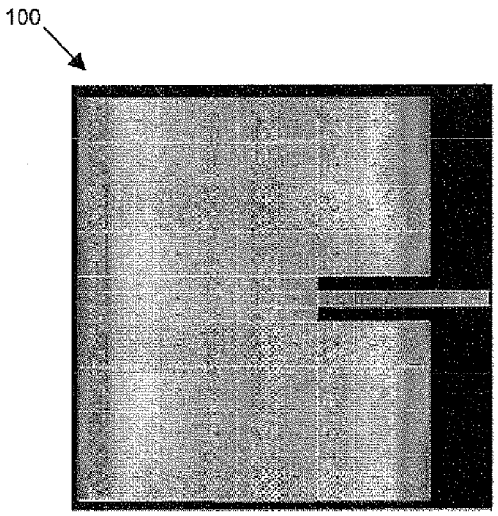
FIG. 10 PRIOR ART
FIG. 10 is a top view of the prior art microstrip antenna of FIG. 1 showing simulated current distribution therefor at a frequency of 1.99 GHz.
Figure 11:
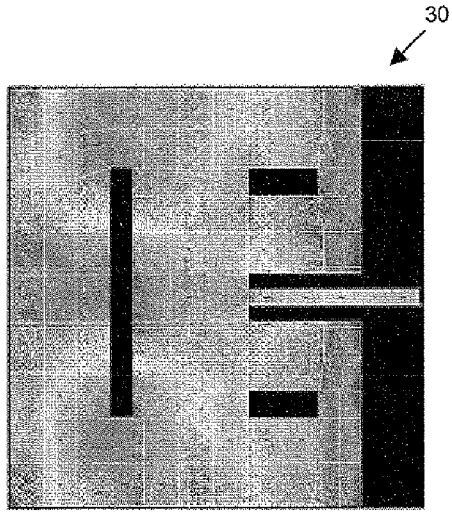
FIG. 11 is a top view of the microstrip antenna of FIG. 3 showing simulated current distribution therefor at a frequency of 1.52 GHz.

From the above-noted graphs it can be observed that the loaded slots A-C provide lower resonant frequency, which will be further understood with reference to the current distributions illustrated in FIGS. 10-12 for the prior art microstrip antenna 100, the microstrip antenna 30 including a symmetrical slot A, and the microstrip antenna 30' with an asymmetrical slot A, respectively. Compared to the current distributions in FIG. 10, the currents in FIG. 11 flow through longer paths due to the loaded slots, especially slot A. In addition, from FIG. 8 it can be seen that the two lower resonant frequencies occur at 1.42 and 1.49 GHz as slot A moves from the center toward the edge. The corresponding current distributions at 1.49 GHz are illustrated in FIG. 12 for the microstrip antenna 30' with the asymmetrical slot A.

Figure 13:
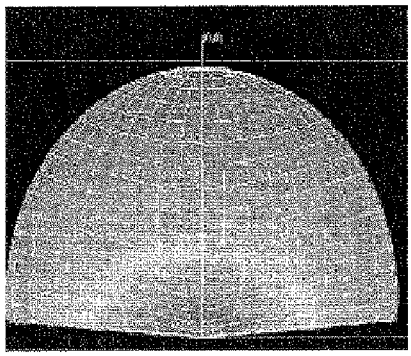
FIG. 13 PRIOR ART
FIGS. 13-15 are simulated 3D far-field radiation pattern diagrams for the microstrip antennas of FIGS. 10-12, respectively.
Figure 14:
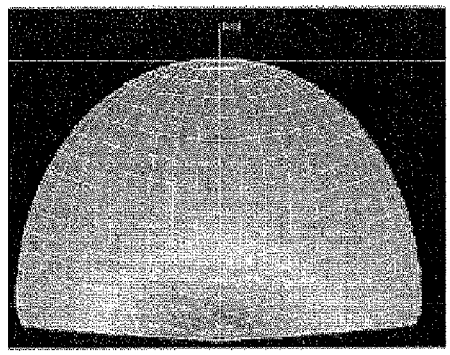
Figure 15:
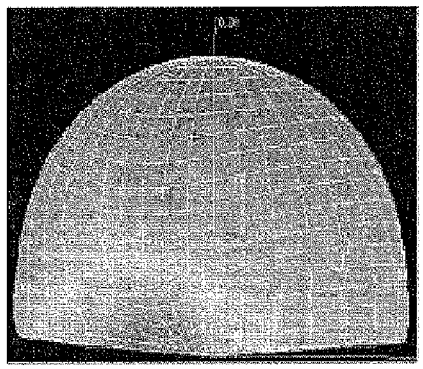
Figure 16:
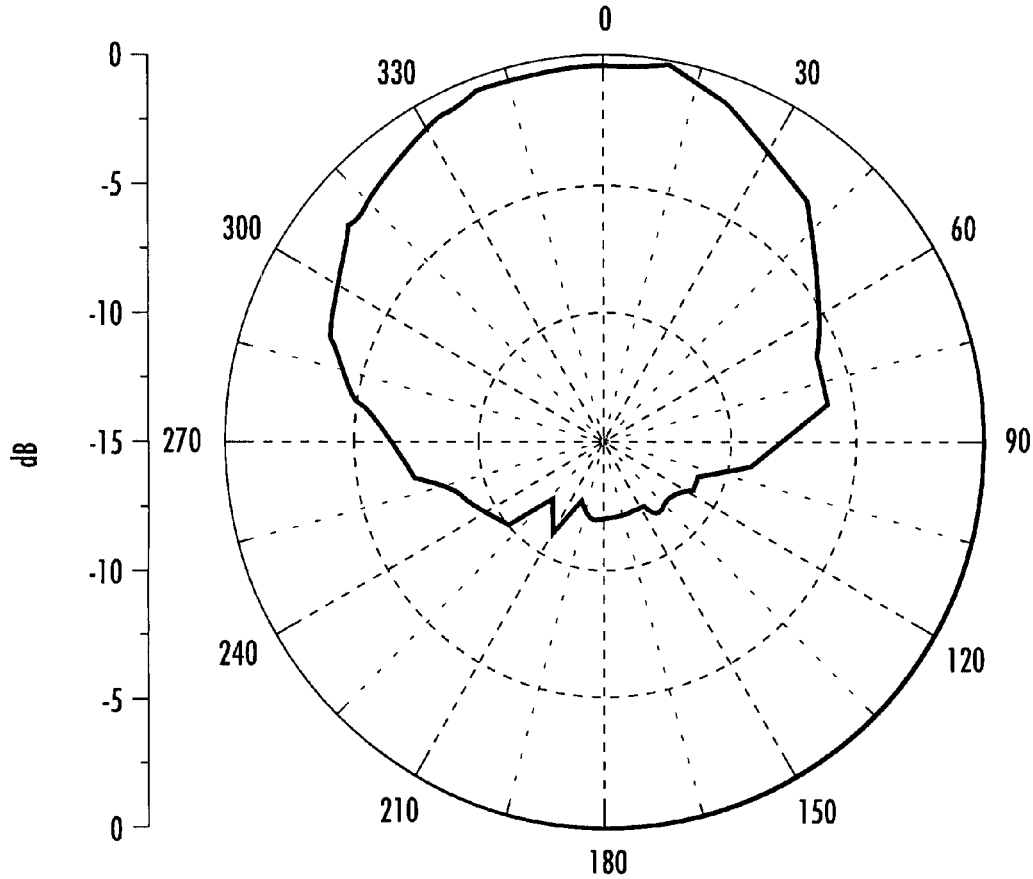
FIGS. 16 and 17 are graphs of measured 2D radiation patterns for the antenna of FIG. 3 on an E-plane and H-plane, respectively.
Figure 17:
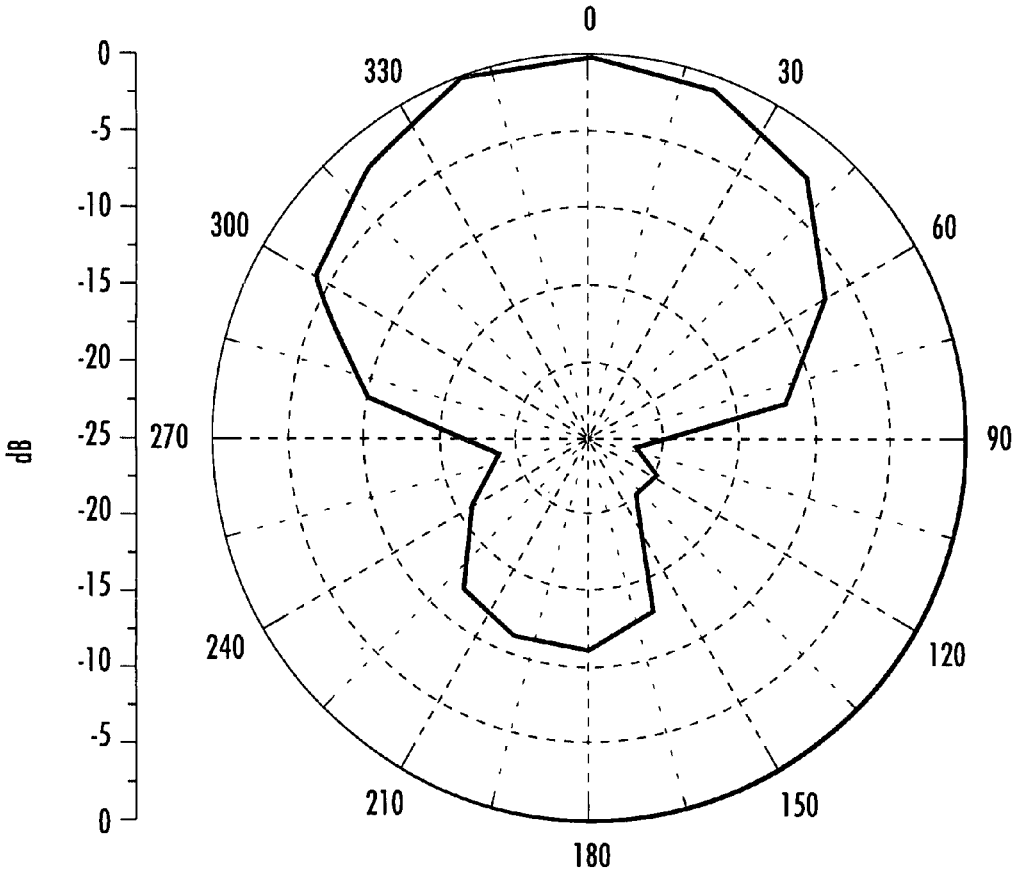

Simulated 3D far-field radiation patterns (with infinite ground planes) at 1.9 GHz, 1.52 GHz, and 1.49 GHz are respectively shown in FIGS. 13-15 for the prior art microstrip antenna 100, the microstrip antenna 30 including a symmetrical slot A, and the microstrip antenna 30' with the asymmetrical slot A. It can be seen that the loaded slots A-C only slightly disturb the gain patterns. Measured 2D radiation patterns at f=1.52 GHz are shown in FIGS. 16 and 17 for the antenna 30 with a symmetrically loaded slot A on the body portion 36 on an E-plane and H-plane, respectively.

The above-described slot loaded microstrip antenna embodiments therefore advantageously provide a relatively easy and low cost approach to reduce the size (and potentially weight in some implementations) of a typical prior art microstrip antenna while maintaining a desired operating frequency and a relatively high gain. With suitable slot placement, the resonant frequency of such a microstrip antenna can be shifted to a lower value, or for a given resonant frequency a slot loaded microstrip antenna has a smaller aperture size than a full (i.e., non-slotted) microstrip patch. Moreover, the slot loaded patch structure may also be relatively easily implemented/manufactured, as compared to more complicated prior art approaches such as multi-layer (i.e., non-planar) patch structures. The above-noted features may also be obtained without the drawbacks associated with using ground pins as discussed in the background above.

Exemplary components of a hand-held mobile wireless communications device 1000 in which the above-described slot loaded antenna embodiments may advantageously be used are now further described with reference to FIG. 18. The device 1000 illustratively includes a housing 1200, a keypad 1400 and an output device 1600. The output device shown is a display 1600, which is preferably a full graphic LCD. Other types of output devices may alternatively be utilized. A processing device 1800 is contained within the housing 1200 and is coupled between the keypad 1400 and the display 1600. The processing device 1800 controls the operation of the display 1600, as well as the overall operation of the mobile device 1000, in response to actuation of keys on the keypad 1400 by the user.

The housing 1200 may be elongated vertically, or may take on other sizes and shapes (including clamshell housing structures). The keypad may include a mode selection key, or other hardware or software for switching between text entry and telephony entry.

Figure 18:
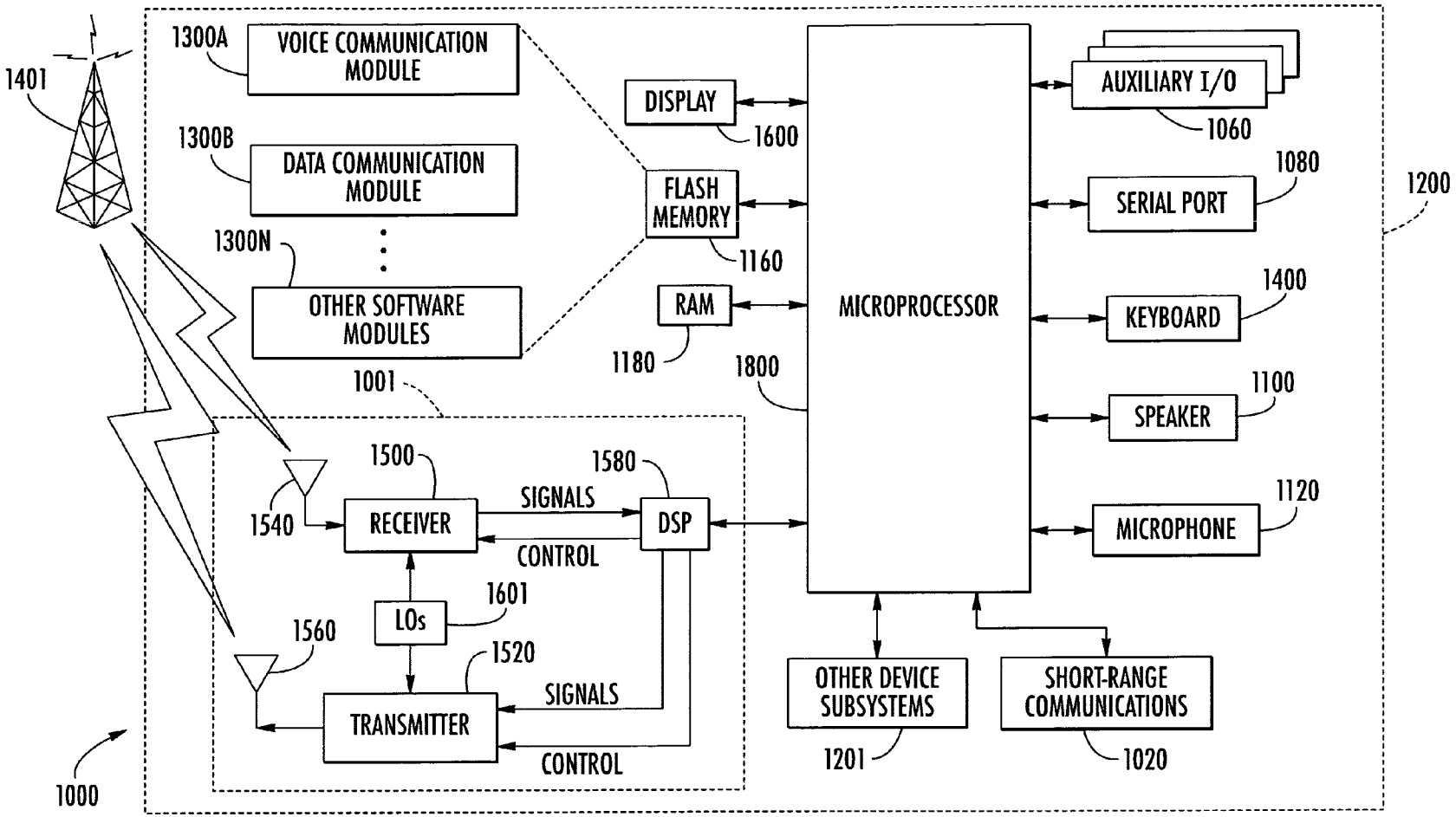
FIG. 18 is a schematic block diagram illustrating exemplary components of a mobile wireless communications device that may include a microstrip antenna such as the one illustrated in FIG. 3.

In addition to the processing device 1800, other parts of the mobile device 1000 are shown schematically in FIG. 18. These include a communications subsystem 1001; a short-range communications subsystem 1020; the keypad 1400 and the display 1600, along with other input/output devices 1060, 1080, 1100 and 1120; as well as memory devices 1160, 1180 and various other device subsystems 1201. The mobile device 1000 is preferably a two-way RF communications device having voice and data communications capabilities. In addition, the mobile device 1000 preferably has the capability to communicate with other computer systems via the Internet.

Operating system software executed by the processing device 1800 is preferably stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (RAM) 1180. Communications signals received by the mobile device may also be stored in the RAM 1180.

The processing device 1800, in addition to its operating system functions, enables execution of software applications 1300A-1300N on the device 1000. A predetermined set of applications that control basic device operations, such as data and voice communications 1300A and 1300B, may be installed on the device 1000 during manufacture. In addition, a personal information manager (PIM) application may be installed during manufacture. The PIM is preferably capable of organizing and managing data items, such as e-mail, calendar events, voice mails, appointments, and task items. The PIM application is also preferably capable of sending and receiving data items via a wireless network 1401. Preferably, the PIM data items are seamlessly integrated, synchronized and updated via the wireless network 1401 with the device user's corresponding data items stored or associated with a host computer system.

Communication functions, including data and voice communications, are performed through the communications subsystem 1001, and possibly through the short-range communications subsystem. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TAC™ or General Packet Radio Service (GPRS) mobile data communications networks, and also designed to operate with any of a variety of voice communications networks, such as AMPS, TDMA, CDMA, WCDMA, PCS, GSM, EDGE, etc. Other types of data and voice networks, both separate and integrated, may also be utilized with the mobile device 1000. The mobile device 1000 may also be compliant with other communications standards such as 3GSM, 3GPP, UMTS, etc.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore requires a subscriber identity module, commonly referred to as a SIM card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device 1060. A device user may also compose data items, such as e-mail messages, using the keypad 1400 and/or some other auxiliary I/O device 1060, such as a touchpad, a rocker switch, a thumb-wheel, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, or a Bluetooth™ communications module to provide for communication with similarly-enabled systems and devices.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. A microstrip antenna comprising:

a single electrically conductive patch layer comprising:

a body portion having an unbroken, contiguous perimeter including a plurality of slots etched completely within the unbroken contiguous perimeter, each slot of the plurality of slots being positioned at a vertical distance from a bottom of the body portion and a horizontal distance from sides of the body portion; and an elongated conductive feed strip extending outwardly from an interior medial portion of the body portion, the feed strip having opposing first and second sides and an end electrically connected to the body portion.

2. The microstrip antenna of claim 1, further comprising:

an electrically conductive ground plane layer; and a dielectric layer adjacent the electrically conductive ground plane layer on a first side and adjacent the electrically conductive patch layer on a second side opposite the electrically conductive ground plane layer.

3. The microstrip antenna of claim 2, wherein the electrically conductive patch layer is electrically floating with respect to the electrically conductive ground plane layer.

4. The microstrip antenna of claim 1, wherein each slot of the plurality of slots has a length dimension and a width dimension; and wherein a location of each slot of the plurality of slots within the body portion determines a resonant frequency of the microstrip antenna.

5. The microstrip antenna of claim 1, the body portion further comprising:

spaced apart first and second elongate slots adjacent respective ones of the first and second opposite sides of the feed strip, and a third elongate slot adjacent the end of the feed strip and spaced from the first and second elongate slots.

6. The microstrip antenna of claim 5, wherein the third elongate slotextends in a direction transverse to a direction of the feed strip.

7. The microstrip antenna of claim 6, wherein the third elongate slot has opposing ends being symmetrically positioned with respect to the feed strip.

8. The microstrip antenna of claim 6, wherein the third elongate slot has opposing ends being asymmetrically positioned with respect to the feed strip.

9. The microstrip antenna of claim 1, wherein the feed strip comprises an elongate electrically conductive strip with the opposing sides in spaced relation from adjacent portions of the body portion.

10. The microstrip antenna of claim 1, wherein the feed strip extends along a vertical centerline of the body portion.

11. A mobile wireless communications device comprising:

a housing;

a microstrip antenna carried within the housing and comprising an electrically conductive ground plane layer;

a dielectric layer adjacent the electrically conductive ground plane layer; and a single electrically conductive patch layer adjacent the dielectric layer on a side thereof opposite the electrically conductive ground plane layer, the single electrically conductive patch layer being electrically floating with respect to the electrically conductive ground plane layer and comprising:

a body portion; and a feed strip extending outwardly from an interior medial portion of the body portion, the feed strip having opposing first and second sides and an end electrically connected to the body portion, the body portion having spaced apart first and second elongate slots adjacent respective ones of the first and second opposite sides of the feed strip, and a third elongate slot adjacent the end of the feed strip and spaced from the first and second elongate slots, the first, second and third elongate slots being positioned at a vertical distance from a bottom of the body portion and a horizontal distance from sides of the body portion; and a wireless communications circuit carried by the housing and coupled to the microstrip antenna.

12. The mobile wireless communications device of claim 11, wherein the single electrically conductive patch layer comprises a planar electrically conductive layer having a rectangular shape.

13. The mobile wireless communications device of claim 11, wherein the first and second slots extend parallel to the feed strip.

14. The mobile wireless communications device of claim 11, wherein the first and second elongate slots have identical shapes and are symmetrically positioned with respect to the feed strip.

15. The mobile wireless communications device of claim 11, wherein the third elongate slot extends in a direction transverse to a direction of the feed strip.

16. The mobile wireless communications device of claim 11, wherein the feed strip comprises an elongate electrically conductive strip with the opposing sides in spaced relation from adjacent portions of the body portion.

17. A method of constructing a microstrip antenna comprising:

etching a plurality of slots of elongate dimensions within a body portion, of a single electrically conductive patch layer, the body portion having an unbroken, contiguous perimeter, each slot of the plurality of slots being positioned at a vertical distance from a bottom of the body portion and a horizontal distance from the sides of the body portion; and electrically connecting a first end of an elongated feed strip to the body portion, the second end of the elongated feed strip extending outwardly from an interior medial portion of the body portion.

18. The method of claim 17, further comprising:

positioning a dielectric layer adjacent an electrically conductive ground plane layer; and positioning an electrically conductive patch layer adjacent the dielectric layer on a side thereof opposite the electrically conductive ground plane layer, the electrically conductive patch layer being electrically floating with respect to the electrically conductive ground plane layer.

19. The method of claim 17, further comprising:

varying the elongate dimensions of each etched slot of the plurality of slots and a distance of each slot from an edge of the body portion to enable tuning of the microstrip antenna to a specified resonant frequency.

20. The method of claim 17, wherein the body portion has spaced apart first and second elongate slots adjacent the respective ones of the first and second opposite sides of the elongated conductive feed strip, and a third elongate slot adjacent the end of the feed strip and spaced from the first and second elongate slots.

21. A wireless transmission device comprising:

a microstrip antenna comprising:

a single electrically conductive planar patch layer comprising:

a body portion having an unbroken, contiguous perimeter including a plurality of slots etched completely within the unbroken contiguous perimeter, each slot of the plurality of slots being positioned at a vertical distance from a bottom of the body portion and a horizontal distance from sides of the body portion; and an elongated conductive feed strip extending outwardly from an interior medial portion of the body portion, the feed strip having opposing first and second sides in spaced relation from adjacent portions of the body portion and an end electrically connected to the body portion.

22. The wireless transmission device of claim 21, further comprising:

a housing including the microstrip antenna disposed therein;

an electrically conductive ground plane layer; and a dielectric layer adjacent the electrically conductive ground plane layer, wherein the electrically conductive planar patch layer is adjacent the dielectric layer on a side thereof opposite the electrically conductive ground plane layer, the electrically conductive planar patch layer electrically floating with respect to the electrically conductive ground plane layer.

23. The wireless transmission device of claim 21, wherein the body portion comprises spaced apart first and second slots adjacent respective ones of the first and second opposite sides of the elongated conductive feed strip, and a third slot adjacent the end of the feed strip and spaced from the first and second slots.

24. The wireless transmission device of claim 23, wherein each slot of the plurality of slots has a length dimension and a width dimension; and wherein a location of each slot of the plurality of slots within the body portion determines a resonant frequency of the antenna.

25. The wireless transmission device of claim 23, wherein the spaced apart first and second slots have identical shapes and are symmetrically positioned with respect to the feed strip.

26. The wireless transmission device of claim 23, wherein the third slot extends in a direction transverse to a direction of the feed strip.

* * * * *